US007316468B2

(12) United States Patent
Kusunoki

(10) Patent No.: US 7,316,468 B2
(45) Date of Patent: Jan. 8, 2008

(54) LIQUID DROPLET EJECTION HEAD, LIQUID DROPLET EJECTION DEVICE AND IMAGE FORMING APPARATUS

(75) Inventor: Naoki Kusunoki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 246 days.

(21) Appl. No.: 11/131,189

(22) Filed: May 18, 2005

(65) Prior Publication Data

US 2005/0259128 A1 Nov. 24, 2005

(30) Foreign Application Priority Data

May 19, 2004 (JP) ..... 2004-149134

(51) Int. Cl.
*B41J 2/155* (2006.01)

(52) U.S. Cl. ..... 347/42; 347/68; 347/70

(58) Field of Classification Search ..... 347/42, 347/57, 65, 68, 84, 85
See application file for complete search history.

(56) References Cited

U.S. PATENT DOCUMENTS 5,565,900 A * 10/1996 Cowger et al. ..... 347/42
6,331,052 B1 * 12/2001 Murai et al. ..... 347/68
6,955,415 B2 * 10/2005 Koblinger et al. ..... 347/44
6,974,205 B2 * 12/2005 Dodd ..... 347/42
7,004,562 B2 * 2/2006 Madeley ..... 347/42
2004/0095421 A1 * 5/2004 Hickman et al. ..... 347/41

FOREIGN PATENT DOCUMENTS

JP 58-38173 A 3/1983
JP 58038173 A * 3/1983
JP 11157056 A 6/1999
JP 2002103604 A 4/2002

* cited by examiner

*Primary Examiner*—Lamson Nguyen
*Assistant Examiner*—Justin Seo
(74) *Attorney, Agent, or Firm*—Birch, Stewart, Kolasch & Birch, LLP

(57) ABSTRACT

The full line type liquid droplet ejection head comprises: a plurality of pressure chambers; and a plurality of nozzles which correspond to the pressure chambers and are two-dimensionally arranged through a length corresponding to a full width of a recording medium conveyed in a sub-scanning direction relatively to the liquid droplet ejection head, wherein a nozzle pitch Pn in the sub-scanning direction between two of the nozzles mutually adjacent in the sub-scanning direction satisfies the following formula: Pn=(m+k)×Pd, where Pd is a minimum pitch between dots in the sub-scanning direction corresponding to a recording resolution in the sub-scanning direction of the dots on the recording medium, m is an integer not less than 1, and k is an arbitrary constant set in a range of 0.4≦k≦0.6.

8 Claims, 12 Drawing Sheets

( Pn = (m+k) × Pd )

LIQUID DROPLET EJECTION HEAD, LIQUID DROPLET EJECTION DEVICE AND IMAGE FORMING APPARATUS

BACKGROUND OF THE INVENTION

1. Field of the Invention

The present invention relates to a liquid droplet ejection head, a liquid droplet ejection device and an image forming apparatus, and more particularly, to a liquid droplet ejection head, a liquid droplet ejection device and an image forming apparatus in which cross-talk is prevented between pressure chambers that are driven consecutively at short time intervals in a liquid droplet ejection head in which nozzles are arranged at high density.

2. Description of the Related Art

Inkjet recording apparatuses (inkjet printers) having an inkjet head (liquid droplet ejection head) in which a plurality of nozzles are arranged, are known in the prior art as image forming apparatuses. An inkjet recording apparatus of this kind forms images by forming dots on a recording medium, by ejecting ink as droplets from nozzles, while causing the inkjet head and the recording medium to move relatively to each other.

Various methods are known conventionally as ink ejection methods for an inkjet recording apparatus of this kind. For example, one known method is a piezoelectric method, where the volume of a pressure chamber (ink chamber) is changed by causing a diaphragm plate forming a portion of the pressure chamber to deform due to deformation of a piezoelectric element (piezoelectric actuator), ink being introduced into the pressure chamber from an ink supply channel when the volume is increased, and the ink inside the pressure chamber being ejected as a droplet from the nozzle when the volume of the pressure chamber is reduced. Another known method is a thermal inkjet method where ink is heated to generate a bubble in the ink, and ink is then ejected by means of the expansive energy created as the bubble grows.

In an inkjet recording apparatus, one image is represented by combining dots formed by ink ejected from the nozzles. In this case, high image quality is achieved by reducing the nozzle diameter and arranging the nozzles at high density, in such a manner that the ink dots deposited by the nozzles become smaller in size and the number of pixels per image is increased.

However, if nozzles are arranged at high density, then there is a danger that cross-talk may arise between nozzles, particularly those which are located close together, in such a manner the ink ejection operation of one nozzle affects the ink ejection operation of the other nozzles. Therefore, in the prior art, various proposals have been made in order to prevent cross-talk of this kind between adjacently positioned nozzles.

For example, it is known that nozzles corresponding to adjacent dots can be divided into a plurality of nozzle rows and arranged in a staggered matrix, in order to prevent cross-talk between adjacent nozzles. Japanese Patent Application Publication No. 2002-103604 discloses an inkjet head in which nozzles are arranged in a matrix fashion, a plurality of nozzle rows arranged in a substantially perpendicular fashion to the printing direction are formed on the same ink supply channel, and adjacent nozzles at the respective orifice hole positions in these nozzle rows are arranged in such a manner that they are staggered by a displacement of $\delta=h/(n\times m)$ in the printing direction, where h is an integer not less than 2, n is the dot density, and m is an integer not less than 5. Moreover, driving signals are sequentially applied to the respective nozzles in such a manner that the displacement of the nozzles is compensated while separating the application timing to mutually adjacent nozzles.

Furthermore, for example, a method is known in which cross-talk is prevented by applying an auxiliary drive signal to the piezoelectric elements other than the piezoelectric element that is performing an ejection operation, in such a manner that the volume displacement of the other ink chambers can be suppressed. Japanese Patent Application Publication No. 11-157056 discloses a method which suppresses the displacement of the restrictor plates corresponding to the piezoelectric elements other than the piezoelectric element performing an ejection operation, by applying a drive signal of the same phase to the piezoelectric elements that are adjacent to the piezoelectric element performing an ejection operation, while applying a drive signal of reverse phase to the piezoelectric elements separated respectively by one element from the piezoelectric element performing the ejection operation.

As described above, when printing at high image resolution by reducing the dot pitch in order to achieve high image quality, it is important to reduce the nozzle pitch, but this pitch reduction has been constrained by the size of the pressure chambers. Conventionally, high nozzle density is achieved by arranging pressure chambers in an oblique two-dimensional array (a staggered array), but if nozzles which are adjacent due to the dot density and nozzle pitch perform ejection at substantially the same time, then a problem arises in that cross-talk occurs between the adjacent nozzles. Therefore, the development of an inkjet recording apparatus which prevents cross-talk has been sought.

However, in the method disclosed in Japanese Patent Application Publication No. 2002-103604, although cross-talk is prevented by arranging nozzles which consecutively perform ejection at a large distance apart, due to the dot density, it is not always possible to completely avoid simultaneous ejection, and therefore the occurrence of cross-talk cannot be completely prevented.

Furthermore, in the method disclosed in Japanese Patent Application Publication No. 11-157056, an auxiliary drive signal is applied to the other piezoelectric elements apart from the piezoelectric element performing an ejection operation, in such a manner that the volume displacement of the other ink chambers can be suppressed; however, it is not possible to prevent interference in the ink between two ink chambers that share the same supply restrictor for supplying ink to the ink chambers.

SUMMARY OF THE INVENTION

The present invention has been contrived with the foregoing circumstances in view, an object thereof being to provide a liquid droplet ejection head, a liquid droplet ejection device, and an image forming apparatus which prevent cross-talk between nozzles which are positioned adjacently and eject liquid droplets consecutively at a short time interval apart.

In order to attain the aforementioned object, the present invention is directed to a full line type liquid droplet ejection head, comprising: a plurality of pressure chambers; and a plurality of nozzles which correspond to the pressure chambers and are two-dimensionally arranged through a length corresponding to a full width of a recording medium conveyed in a sub-scanning direction relatively to the liquid droplet ejection head, wherein a nozzle pitch Pn in the sub-scanning direction between two of the nozzles mutually adjacent in the sub-scanning direction satisfies the following formula: $Pn=(m+k)\times Pd$, where Pd is a minimum pitch between dots in the sub-scanning direction corresponding to a recording resolution in the sub-scanning direction of the dots on the recording medium, m is an integer not less than 1, and k is an arbitrary constant set in a range of $0.4 \leqq k \leqq 0.6$.

According to the present invention, by staggering the phase of the ejection cycles of the nozzles which are adjacent in the sub-scanning direction, it is possible to prevent cross-talk due to the supply system between pressure chambers corresponding to nozzles which are positioned adjacently and perform ejection in a consecutive fashion.

In order to attain the aforementioned object, the present invention is also directed to a full line type liquid droplet ejection head, comprising: a plurality of pressure chambers; and a plurality of nozzles which correspond to the pressure chambers and are two-dimensionally arranged through a length corresponding to a full width of a recording medium conveyed in a sub-scanning direction relatively to the liquid droplet ejection head, wherein a nozzle pitch Pn in the sub-scanning direction between two of the nozzles corresponding to two of the pressure chambers sharing a supply restrictor through which liquid is supplied to the two of the pressure chambers satisfies the following formula: $Pn=(m+k)\times Pd$, where Pd is a minimum pitch between dots in the sub-scanning direction corresponding to a recording resolution in the sub-scanning direction of the dots on the recording medium, m is an integer not less than 1, and k is an arbitrary constant set in a range of $0.4 \leqq k \leqq 0.6$.

According to the present invention, it is possible to effectively prevent cross-talk which has an extremely significant effect in an ink supply system where two pressure chambers share one supply restrictor.

Preferably, the constant k is 0.5.

Preferably, the two of the nozzles are mutually adjacent in the sub-scanning direction or a direction oblique to the sub-scanning direction; the two of the pressure chambers corresponding to the two of the nozzles are connected to a supply flow channel through supply ports through which the liquid is supplied to the two of the pressure chambers; and the supply flow channel is connected to a common liquid chamber through the supply restrictor.

Preferably, each of the pressure chambers has approximately a square plane shape; in each of the pressure chambers, the nozzle and the supply port are arranged on a diagonal of the pressure chamber; and the supply ports of the two of the pressure chambers which are adjacent in the direction oblique to the sub-scanning direction are arranged in mutually proximate and opposing positions.

Since a supply restrictor is shared by two pressure chambers in this way, it is possible to reduce the number of supply restrictors, which have very strict processing accuracy requirements, and therefore the processing accuracy of the supply restrictors can be improved.

In order to attain the aforementioned object, the present invention is also directed to a liquid droplet ejection device, comprising: the above-described liquid droplet ejection head; and an actuator control device which controls drive waveforms for actuators to generate pressure in the pressure chambers, wherein: each of the drive waveforms includes: an ejection region which has an ejection drive waveform for applying pressure to the pressure chamber so as to actually eject a droplet of the liquid from the nozzle; and a standby region which does not have the ejection drive waveform and does not cause ejection; when the drive waveform corresponding to one of the two of the pressure chambers which share the supply restrictor is in the ejection region, then the drive waveform corresponding to the other of the two of the pressure chambers is in the standby region; and the standby region has an auxiliary drive waveform which is a waveform acting in same direction as, and being synchronized with, the ejection drive waveform in the ejection region of the drive waveform corresponding to the one of the two of the pressure chambers, the auxiliary drive waveform being of a magnitude which does not cause ejection of a droplet of the liquid.

According to the present invention, it is possible to improve the cross-talk prevention effect yet further, by controlling the drive waveforms, and the ejection pressure wave of the pressure chamber performing an ejection operation can be transmitted efficiently to the nozzle from which liquid is to be ejected.

In order to attain the aforementioned object, the present invention is also directed to an image forming apparatus, comprising the above-described liquid droplet ejection head.

In order to attain the aforementioned object, the present invention is also directed to an image forming apparatus, comprising the above-described liquid droplet ejection device.

As described above, according to the liquid droplet ejection head, the liquid droplet ejection device and the image forming apparatus according to the present invention, it is possible to prevent cross-talk between nozzles which are positioned adjacently and which eject liquid droplets consecutively at a short time interval apart.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
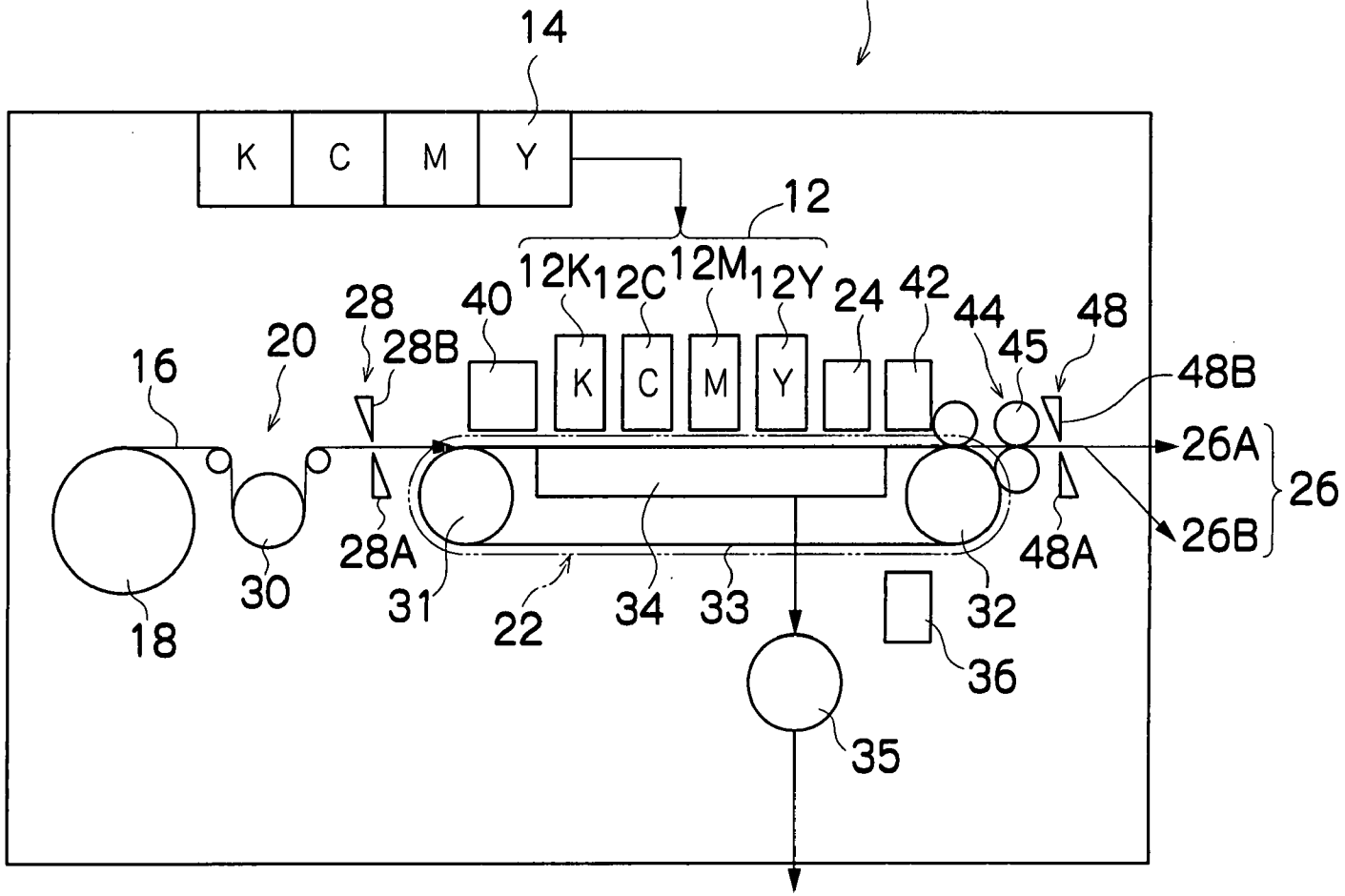
FIG. 1 is a general compositional diagram showing an approximate view of an inkjet recording apparatus forming an image forming apparatus according to a first embodiment of the present invention.

FIG. 1 is a general compositional diagram showing an approximate view of an inkjet recording apparatus forming an image forming apparatus according to a first embodiment of the present invention.

As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of magazines for rolled papers.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called full-line head (see FIG. 2) having a length corresponding to the maximum paper width, and it comprises print heads 12K, 12C, 12M and 12Y corresponding to the four colors (black (K), cyan (C), magenta (M) and yellow (Y)), each of the print heads 12K, 12C, 12M, and 12Y having a plurality of ejection ports (nozzles) and being arranged in such a manner that the lengthwise direction of the print heads 12K, 12C, 12M, and 12Y is aligned with the breadthways direction of the recording paper 16 (the main scanning direction) which is perpendicular to the conveyance direction of the paper (the sub-scanning direction).

Figure 2:
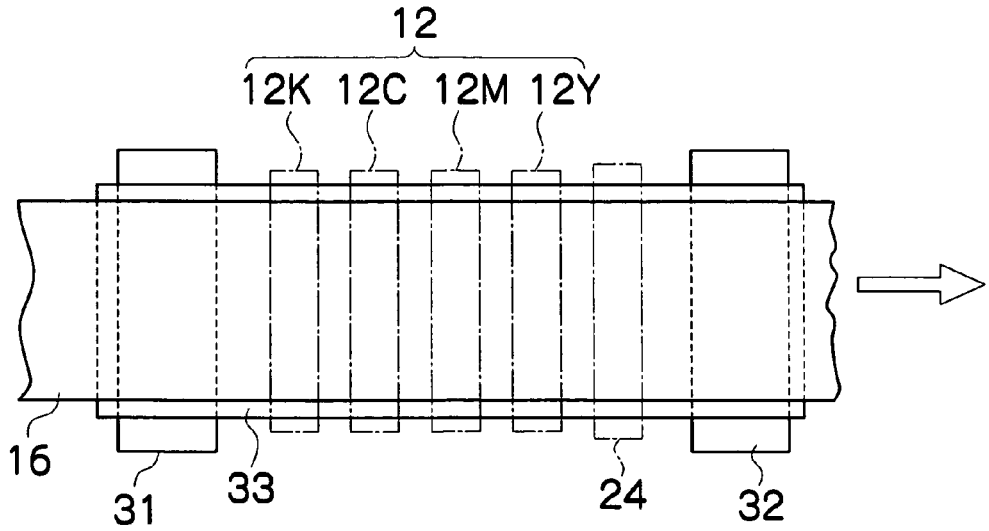
FIG. 2 is a plan view of the principal part of the peripheral area of a print unit in the inkjet recording apparatus shown in FIG. 1.

As shown in FIG. 2, the print heads 12K, 12C, 12M and 12Y are constituted by line heads in which a plurality of ink ejection ports (nozzles) are arranged in the lengthwise direction of the head through a length exceeding at least one side of the maximum size recording paper 16 intended for use with the inkjet recording apparatus 10.

Although described in more detail below, the print heads 12K, 12C, 12M, and 12Y comprise a determination device for determining ink ejection, an optical system for forming a light beam of a prescribed shape for determination purposes, and various other devices relating to the determination of the ink ejection state, the ink droplet size, the ink ejection speed, and the like.

The print heads 12K, 12C, 12M, 12Y corresponding to respective ink colors are disposed in the order, black (K), cyan (C), magenta (M) and yellow (Y), from the upstream side (left-hand side in FIG. 2), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in the direction (main scanning direction) which is perpendicular to the paper conveyance direction (sub-scanning direction).

Here, the terms main scanning direction and sub-scanning direction are used in the following senses. In a full-line head comprising rows of nozzles that have a length corresponding to the entire width of the recording paper, the "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with the four standard colors, KCMY, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, via a tube channel (not illustrated). Moreover, the ink storing and loading unit 14 also comprises notifying means (display means, alarm generating means, or the like) for generating a notification if the remaining amount of ink has become low, as well as having a mechanism for preventing incorrect loading of the wrong colored ink.

The print determination unit 24 illustrated in FIG. 1 has an image sensor (line sensor, or the like) for capturing an image of the ink-droplet deposition result of the print unit 12, and functions as a device to check for ejection defects such as blocking of the nozzles in the print unit 12, from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row comprising photoelectric transducing elements (pixels) arranged in a line provided with an R filter, a green (G) sensor row with a G filter, and a blue (B) sensor row with a B filter. Instead of a line sensor, it is possible to use an area sensor comprising photoelectric transducing elements which are arranged two-dimensionally.

The print determination unit 24 reads a test pattern image printed by the print heads 12K, 12C, 12M, and 12Y for the respective colors, and the ejection from each head 12K, 12C, 12M and 12Y is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although omitted from the drawing, a sorter for collating and stacking the images according to job orders is provided in the paper output section 26A corresponding to the target prints.

Figure 3:
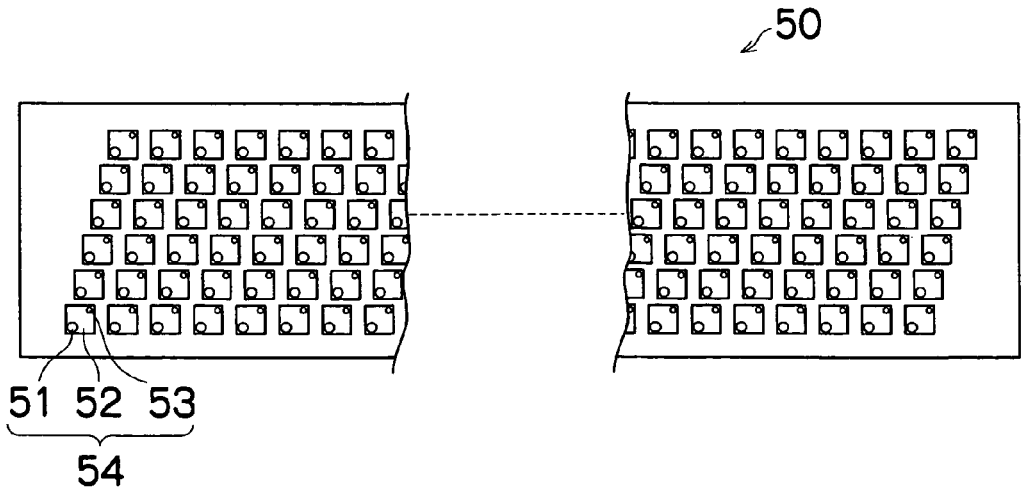
FIG. 3 is a plan view showing the region of a print head in the inkjet recording apparatus shown in FIG. 1.

Next, the structure of a print head will be described. The print heads 12K, 12C, 12M and 12Y provided for the respective ink colors have the same structure, and one print head 50 is described as a representative example of these print heads. FIG. 3 shows a plan diagram of the print head 50.

As shown in FIG. 3, the print head 50 according to the present embodiment achieves a high density arrangement of nozzles 51 by using a two-dimensional array of pressure chamber units 54, each constituted by a nozzle for ejecting ink, a pressure chamber 52 for applying pressure to the ink in order to eject ink, and an ink supply port 53 for supplying ink to the pressure chamber 52 from a common flow channel (not illustrated).

Figure 4:
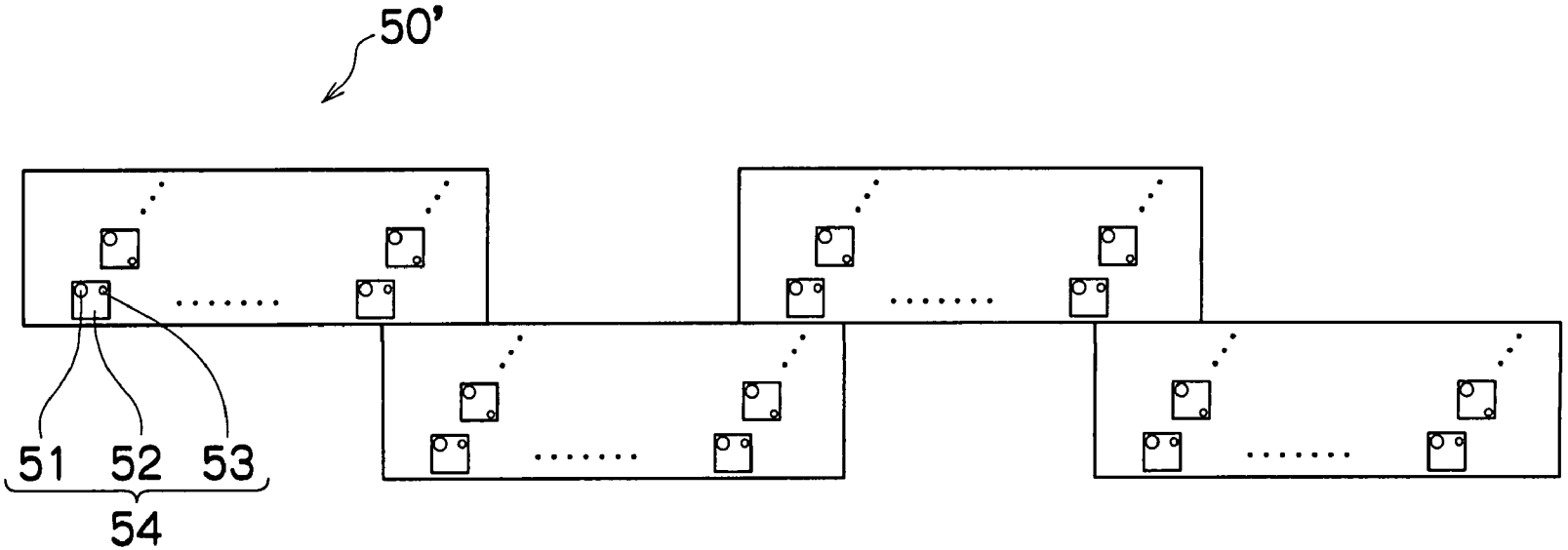
FIG. 4 is a plan view showing a further example of a print head.

In the present embodiment, as shown in FIG. 2, the print heads 12K, 12C, 12M, and 12Y (print head 50) form a full line head as shown in FIG. 3, in which a plurality of ink ejection ports (nozzles 51) are arranged through a length exceeding at least one edge of the maximum-size recording paper 16 intended for use with the inkjet recording apparatus 10. However, as shown in FIG. 4, it is also possible to achieve a length corresponding to the full width of the recording medium by arranging and joining together in a staggered matrix, a plurality of short heads 50' in which pressure chamber units 54 corresponding to nozzles 51 are disposed in a two-dimensional array. In this case, the nozzle arrangement according to the present embodiment as described below is adopted in each of the short heads 50'.

Figure 5:
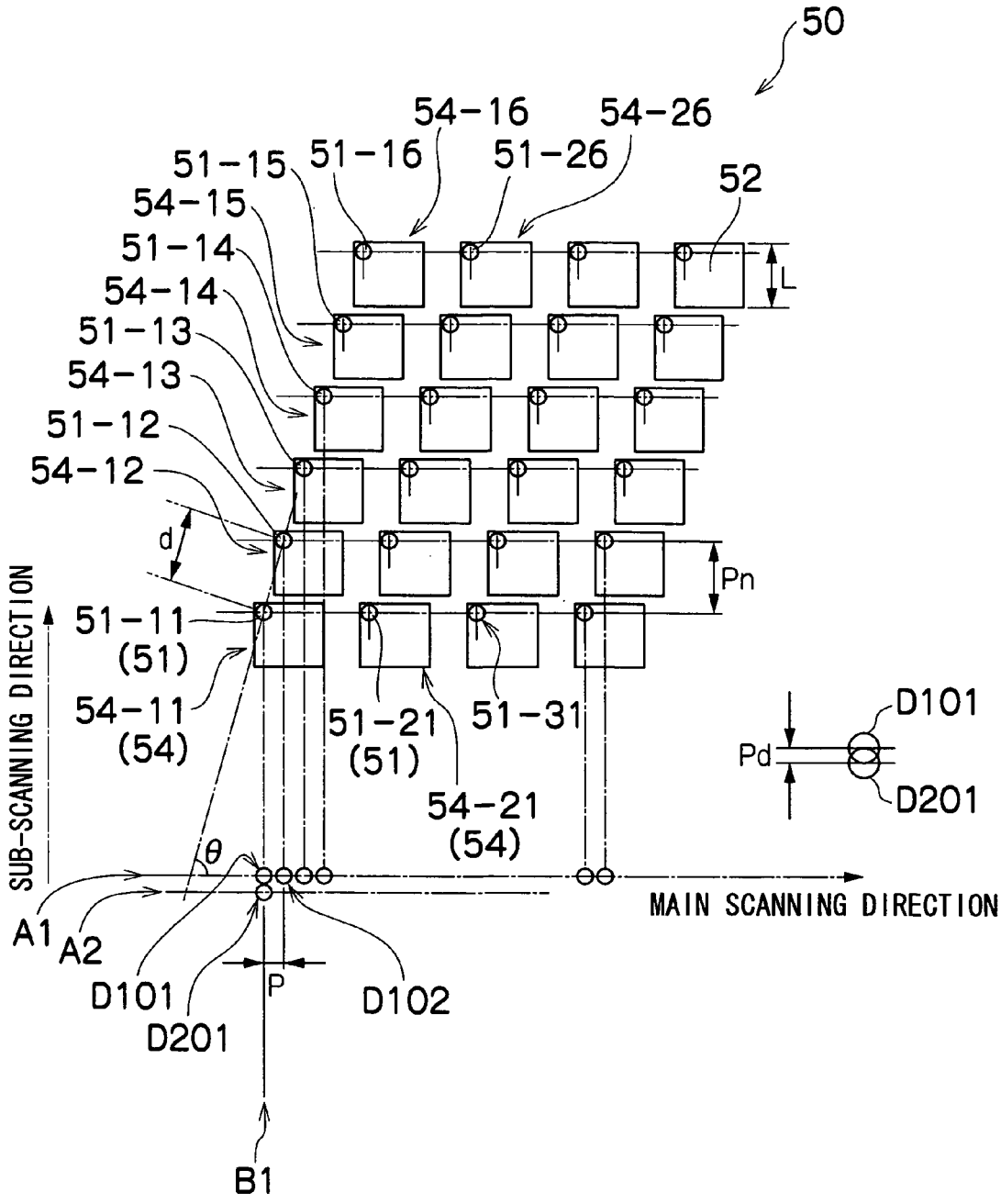
FIG. 5 is a plan diagram showing a nozzle arrangement in a print head according to the first embodiment.

FIG. 5 shows an enlarged view of a portion of the print head 50. In order to achieve high density pitch of the dots printed onto the recording paper 16, as described above, the print head 50 according to the present embodiment has a structure in which a plurality of pressure chamber units 54 comprising nozzles 51 for ejecting ink droplets and pressure chambers 52 corresponding respectively to each nozzle 51 are arranged in a two-dimensional staggered matrix, thereby achieving high density of the apparent nozzle pitch.

As shown in FIG. 5, a plurality of pressure chamber units 54 are arranged in a lattice array according to a prescribed arrangement pattern, in a line direction following the main scanning direction, and a row direction following an oblique direction which has a prescribed angle θ other than a right angle (90°) with respect to the main scanning direction.

In this way, the plurality of pressure chamber units 54 (54-11, 54-12, 54-13, and so on) are arranged at a uniform pitch d in the row direction which forms an angle of θ (where θ≠90°) with respect to the main scanning direction (line direction), and due to this composition, the pitch P of the nozzles 51 (51-11, 51-12, 51-13, and so on) when projected (forwards) in the main scanning direction is d×cos θ. In other words, the dot pitch in the main scanning direction of dots deposited onto the recording paper 16 by the print head 50 is P=d×cos θ.

Here, a case is considered in which dots are deposited onto the recording paper 16 by a print head 50 having nozzles 51 arranged in this fashion. As shown in FIG. 5, the center-to-center distance between the dots which are mutually adjacent in the main scanning direction on the recording paper 16 (for example, D101 and D102), in other words, the dot pitch in the main scanning direction, is P, as described above, and the center-to-center distance between dots which are mutually adjacent in the sub-scanning direction (for example, D101 and D201), in other words, the dot pitch in the sub-scanning direction, is Pd. Furthermore, the distance between nozzles which are mutually adjacent in the sub-scanning direction and which eject ink-droplets to form dots that are adjacent in the main scanning direction on the recording paper (for example, nozzles 51-11 and 51-12), in other words, the nozzle pitch in the sub-scanning direction is Pn, and the length of each pressure chamber 52 forming a pressure chamber unit 54 in the sub-scanning direction is L. The dot pitch in the sub-scanning direction, Pd, is the so-called "recording resolution", and is decided by the specifications of the apparatus. Normally, the recording resolution of an output print can be set to various values, according to the print mode. For example, a plurality of modes can be set, such as high-resolution mode (Pd=P1), medium-resolution mode (Pd=P2), and low-resolution mode (Pd=P3), the modes being variable depending on the objective (P1<P2<P3). The present invention may be applied to any of the aforementioned plurality of resolution modes.

In this case, firstly, in the deposition of the dot D101 at the left-hand end of a line A1 extending in the main scanning direction, an ink droplet to form the dot D101 is ejected from the nozzle 51-11 when the recording paper 16 has been conveyed to a point where the position at which the dot D101 is to be deposited on the recording paper 16 is directly below the nozzle 51-11.

Thereupon, the recording paper 16 is conveyed through a length corresponding to the nozzle pitch Pn in the sub-scanning direction, and when the position where the dot D102 is to be deposited arrives directly below the nozzle 51-12, then an ink droplet to form the dot D102 is ejected from the nozzle 51-12.

In this case, if there are dots to be deposited consecutively onto a line B1 extending in the sub-scanning direction where the nozzle 51-11 is situated, then while the recording paper 16 is being conveyed (through the nozzle pitch Pn) to a point where the position at which dot D102 is to be deposited arrives under the nozzle 51-12, the nozzle 51-11 ejects a droplet each time the recording paper 16 is conveyed through the sub-scanning direction dot pitch Pd (in other words, this is taken as the ejection frequency in the sub-scanning direction).

For example, when a dot D201, which is adjacent in the sub-scanning direction to a previously deposited dot D101, is deposited onto a line A2, which extends in the main scanning direction adjacently to the line A1, then a droplet to form the dot D201 is ejected from the nozzle 51-11 when the recording paper 16 has been conveyed through a distance equal to the dot pitch Pd in the sub-scanning direction. In the time region immediately after the start of recording onto the recording paper 16, in particular, while the recording paper 16 is conveyed through the nozzle pitch Pn in the sub-scanning direction, ejection is performed only by the nozzle 51-11 (and by the nozzles 51-21, 51-31, and so on which are aligned with the nozzle 51-11 in the main scanning direction).

In this case, depending on the relationship between the dot pitch Pd in the sub-scanning direction and the nozzle pitch Pn in the sub-scanning direction, it may occur that the nozzle 51-11 and the nozzle 51-12 simultaneously eject droplets. In other words, if the nozzle pitch Pn in the sub-scanning direction is an integral multiple of the dot pitch Pd in the sub-scanning direction, then simultaneous ejection of droplets by the nozzle 51-11 and the nozzle 51-12 may occur, and hence there is a risk of cross-talk.

Therefore, in the present embodiment, the nozzles are arranged in such a manner that cross-talk is avoided by preventing mutually proximate nozzles from ejecting droplets in a substantially simultaneous fashion. More specifically, taking m to be an integer not less than 1, the nozzles 51 are arranged in such a manner that the nozzle pitch Pn in the sub-scanning direction of nozzles 51 that are adjacent in the sub-scanning direction, such as nozzle 51-11 and nozzle 51-12, satisfies the following formula (1):

$$Pn=\{m+(1/2)\}\times Pd. \quad (1)$$

Thereby, the ejection timings of the nozzle 51-11 and the nozzle 51-12 are staggered by half a cycle, thereby resolving the problem of cross-talk between the nozzles 51-11 and 51-12, which are adjacent in the sub-scanning direction. When adopting a nozzle arrangement of this kind, it is assumed that the conveyance speed of the recording paper 16 is constant.

More specifically, if the recording paper 16 is conveyed at a uniform speed at all times, then by arranging the nozzles that are adjacent in the sub-scanning direction in such a manner that the nozzle pitch Pn satisfies the formula (1), then looking at the nozzle 51-11 and the nozzle 51-12, for example, in a steady state where ejection is also to be performed from the nozzle 51-12 after the start of printing, a droplet is ejected from the nozzle 51-11, whereupon the recording paper 16 is conveyed through ½ pitch (in other words, (½)×Pn) and a droplet is ejected from the nozzle 51-12. Thereupon, the recording paper 16 is conveyed again through ½ pitch and a droplet is ejected again from the nozzle 51-11. In this way, ejection is performed in alternating fashion from the nozzle 51-11 and the nozzle 51-12, which are adjacent in the sub-scanning direction, and since they do not simultaneously perform ejection, the problem of cross-talk is resolved.

Desirably, the value of m in the formula (1) is set in such a manner that the nozzle pitch Pn is as small as possible, in order to achieve high nozzle density; however, the nozzle pitch Pn in the sub-scanning direction cannot be set to a distance shorter than the length L in the sub-scanning direction, since a distance corresponding to the thickness of the walls of the pressure chamber 52 must be ensured. Consequently, by setting Pn to a minimum value within a range where Pn>L, it is possible both to achieve high density arrangement of nozzles while also preventing cross-talk between adjacent nozzles.

More specifically, if the dot pitch in the sub-scanning direction is 20 μm (which is the dot pitch corresponding to a recording resolution of approximately 1,200 dots per inch (dpi)) and the length L of each pressure chamber 52 in the sub-scanning direction is 150 μm, then m can be set to m=8. In this case, the nozzle pitch Pn in the sub-scanning direction is set to Pn={8+(½)}×20=170 μm. Here, if m is set to a smaller value, such as m=7, for instance, then the nozzle pitch Pn becomes Pn={7+(½)}×20=150 μm, which coincides with the length L of the pressure chambers 52 in the sub-scanning direction. Therefore, this value is not appropriate since it does not allow sufficient space to be guaranteed for the walls which separate the respective pressure chambers 52. Consequently, in this case, m=8 is the setting which allows the highest possible nozzle density to be achieved.

Furthermore, the nozzles are arranged in such a manner that the ejection cycles are staggered by ½ pitch in the formula (1); however, a cross-talk prevention effect is still obtained even if the value by which the pitch is staggered is set to an appropriate value within the range of 0.4 to 0.6, rather than ½. More specifically, it is possible to set the nozzle pitch Pn so as to satisfy the following formula (2), instead of the formula (1), by taking k to be any value in the range between 0.4 and 0.6, namely, provided that 0.4<k<0.6:

$$Pn=(m+k)\times Pd. \quad (2)$$

Although cross-talk can be prevented by staggering the phase of the ejection cycles of nozzles which are adjacent in the sub-scanning direction, in such a manner that formula (2) is satisfied, the greatest effect in preventing cross-talk is obtained if k=½ (=0.5).

Figure 6:
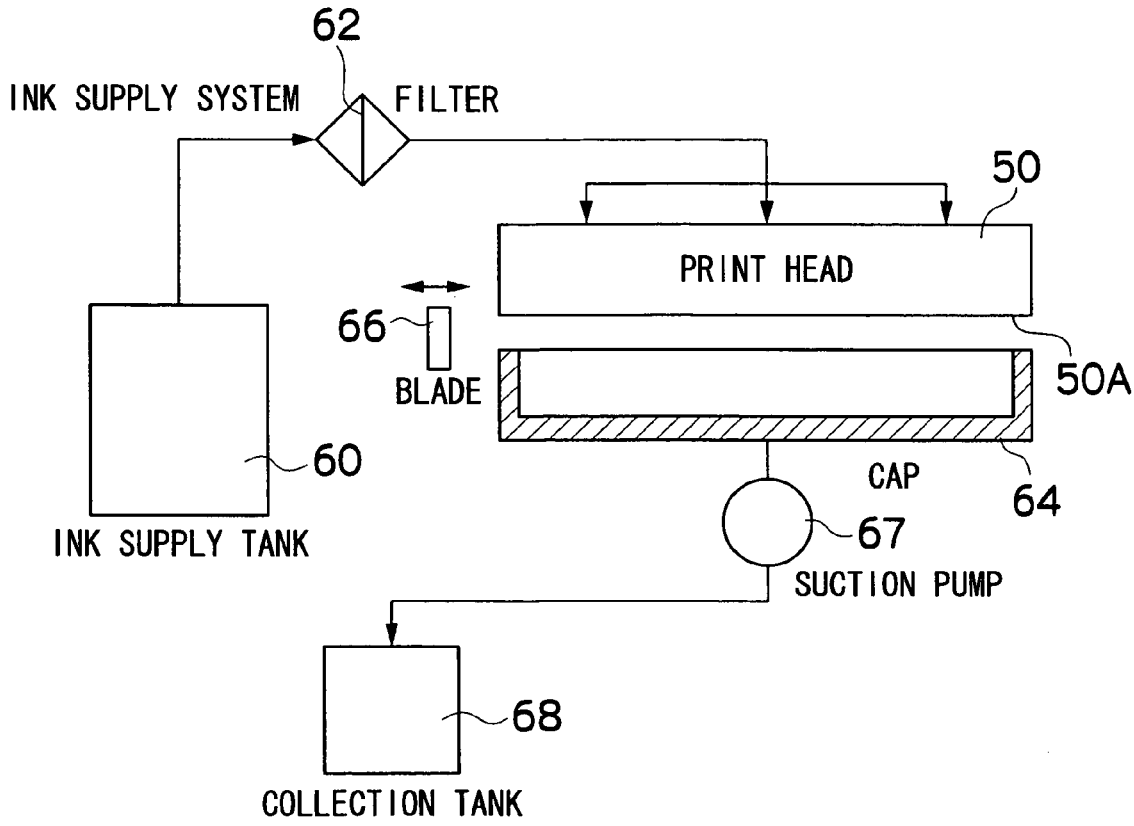
FIG. 6 is an approximate diagram showing the composition of an ink supply system in the inkjet recording apparatus.

Next, the composition of the ink supply system will be described. FIG. 6 shows the approximate composition of the ink supply system in the inkjet recording apparatus 10 according to the present embodiment.

In FIG. 6, the ink tank 60 is a base tank for supplying ink to the print head 50, and this ink tank 60 is disposed in the ink storing and loading unit 14 illustrated in FIG. 1. The ink tank 60 may adopt a system for replenishing ink by means of a replenishing port (not illustrated), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, attached to a cartridge, or the like, and the ejection of the ink is controlled in accordance with the ink type. The ink supply tank 60 in FIG. 6 is equivalent to the ink storing and loading unit 14 in FIG. 1 described above.

As shown in FIG. 6, a filter 62 for eliminating foreign material and air bubbles is provided at an intermediate position of the tubing which connects the ink tank 60 with the print head 50. Desirably, the filter mesh size is the same as the nozzle diameter in the print head 50, or smaller than the nozzle diameter (generally, about 20 μm).

Although not shown in FIG. 6, desirably, a composition is adopted in which a subsidiary tank is provided in the vicinity of the print head 50, or in an integrated manner with the print head 50. The subsidiary tank has the function of improving damping effects and refilling, in order to prevent variations in the internal pressure inside the head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face 50A.

A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle area of the nozzle face 50A is thereby covered with the cap 64.

The cleaning blade 66 comprises rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or standby, when the frequency of use of specific nozzles 51 is reduced and ink viscosity increases in the vicinity of the nozzles, a preliminary discharge is made toward the cap 64 to eject the degraded ink.

Also, when bubbles have become intermixed in the ink inside the print head 50 (inside the pressure chamber 52), the cap 64 is placed on the print head 50, ink (ink in which bubbles have become intermixed) inside the pressure chamber 52 is removed by suction with a suction pump 67, and the suction-removed ink is sent to a collection tank 68. This suction action entails the suctioning of degraded ink of which viscosity has increased (hardened) when initially loaded into the head, or when service has started after a long period of being stopped.

In other words, when a state in which ink is not ejected from the print head 50 continues for a certain amount of time or longer, the ink solvent in the vicinity of the nozzles evaporates and the ink viscosity increases. In such a state, ink can no longer be ejected from the nozzles 51 even if the ejection drive actuators (piezoelectric elements) which cause the ink to be ejected by deforming the pressure chambers 52 are operated. Before reaching such a state the actuator is operated (in a viscosity range that allows ejection by the operation of the actuator), and the preliminary discharge is made toward the ink receptor to which the ink of which viscosity has increased in the vicinity of the nozzle is to be ejected. After the nozzle surface 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, if an air bubble has been introduced into the ink in the nozzle of the pressure chamber 52, or if the ink viscosity inside the nozzles 51 has risen to a certain level or above, then even if the actuator is operated, it becomes impossible to eject ink from the nozzles 51. In a case of this kind, a cap 64 is placed on the nozzle surface 50A of the print head 50, and the ink containing air bubbles or the ink of increased viscosity inside the pressure chambers 52 is suctioned by a pump 67.

However, this suction action is performed with respect to all the ink in the pressure chamber 52, and therefore the amount of ink consumption is considerable. Consequently, it is desirable that a preliminary ejection is carried out, whenever possible, while the increase in viscosity is still minor. The cap 64 described in FIG. 6 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 7:
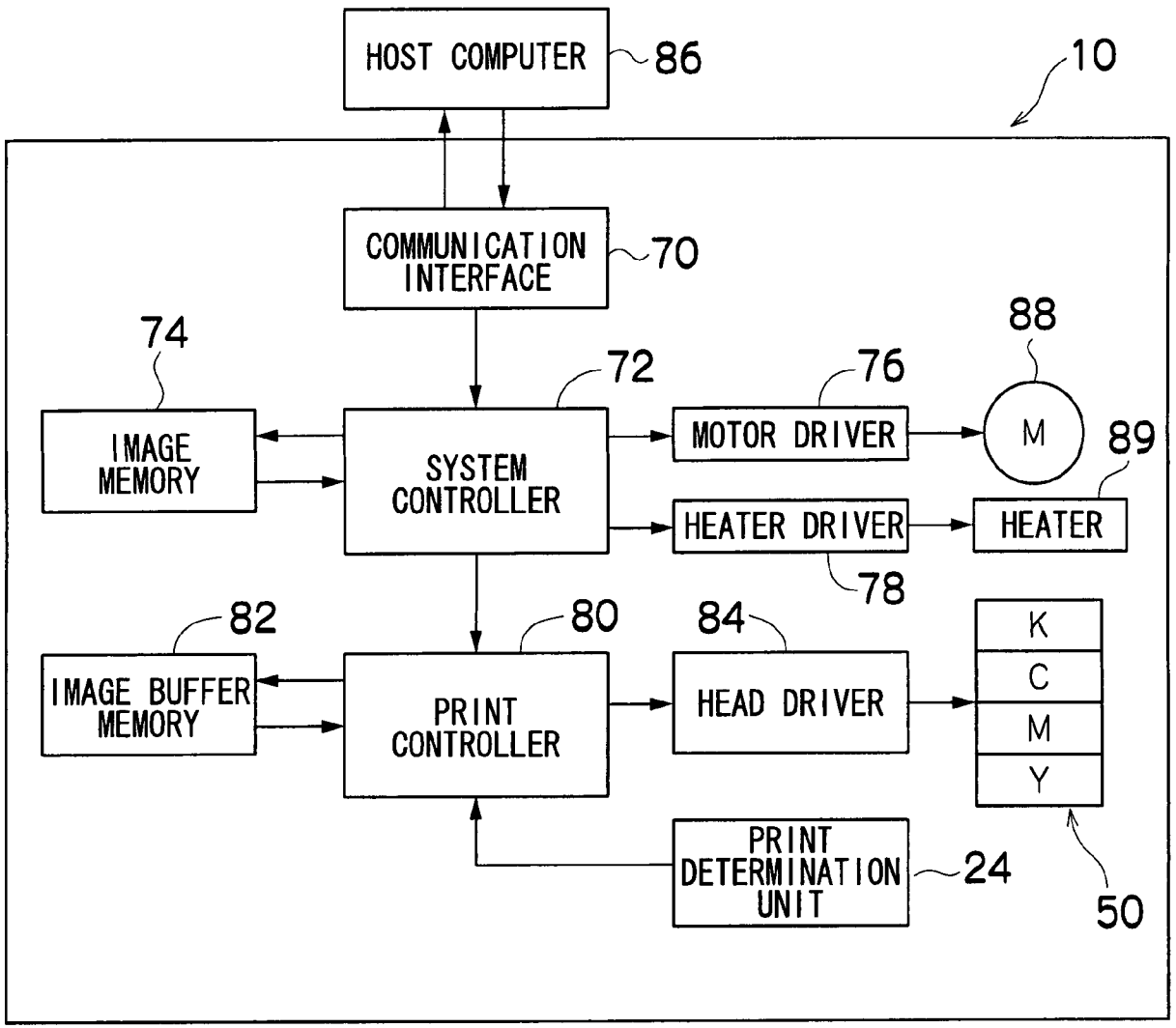
FIG. 7 is a principal block diagram showing the system composition of the inkjet recording apparatus.

Next, the control system of the inkjet recording apparatus 10 according to the present embodiment will be described. FIG. 7 shows the approximate system composition of the inkjet recording apparatus 10 according to the present embodiment.

As shown in FIG. 7, the inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory comprising a semiconductor element, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 is a control unit having a signal processing function for performing various treatment processes, corrections, and the like, in accordance with the control implemented by the system controller 72, in order to generate a signal for controlling printing from the image data in the image memory 74. The print controller 80 supplies the print control signal (image data) thus generated to the head driver 84. Prescribed signal processing is carried out in the print controller 80, and the ejection amount and the ejection timing of the ink droplets from the print head 50 are controlled via the head driver 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 is an actuator control section for controlling the drive waveform used to drive the actuators 58 which drive ejection in the respective color heads 50, on the basis of the print data supplied from the print controller 80. A feedback control system for maintaining constant drive conditions for the print heads may be included in the head driver 84.

The print determination unit 24 is a block that includes the line sensor (not shown) as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80.

According to requirements, the print controller 80 makes various corrections with respect to the print head 50 on the basis of information obtained from the print determination unit 24.

Next, a second embodiment of the present invention will be described. The second embodiment prevents cross-talk by arranging nozzles as in the first embodiment described above, and furthermore, a supply restrictor for supplying ink to the pressure chamber is shared by a plurality of pressure chambers.

Figure 8A:
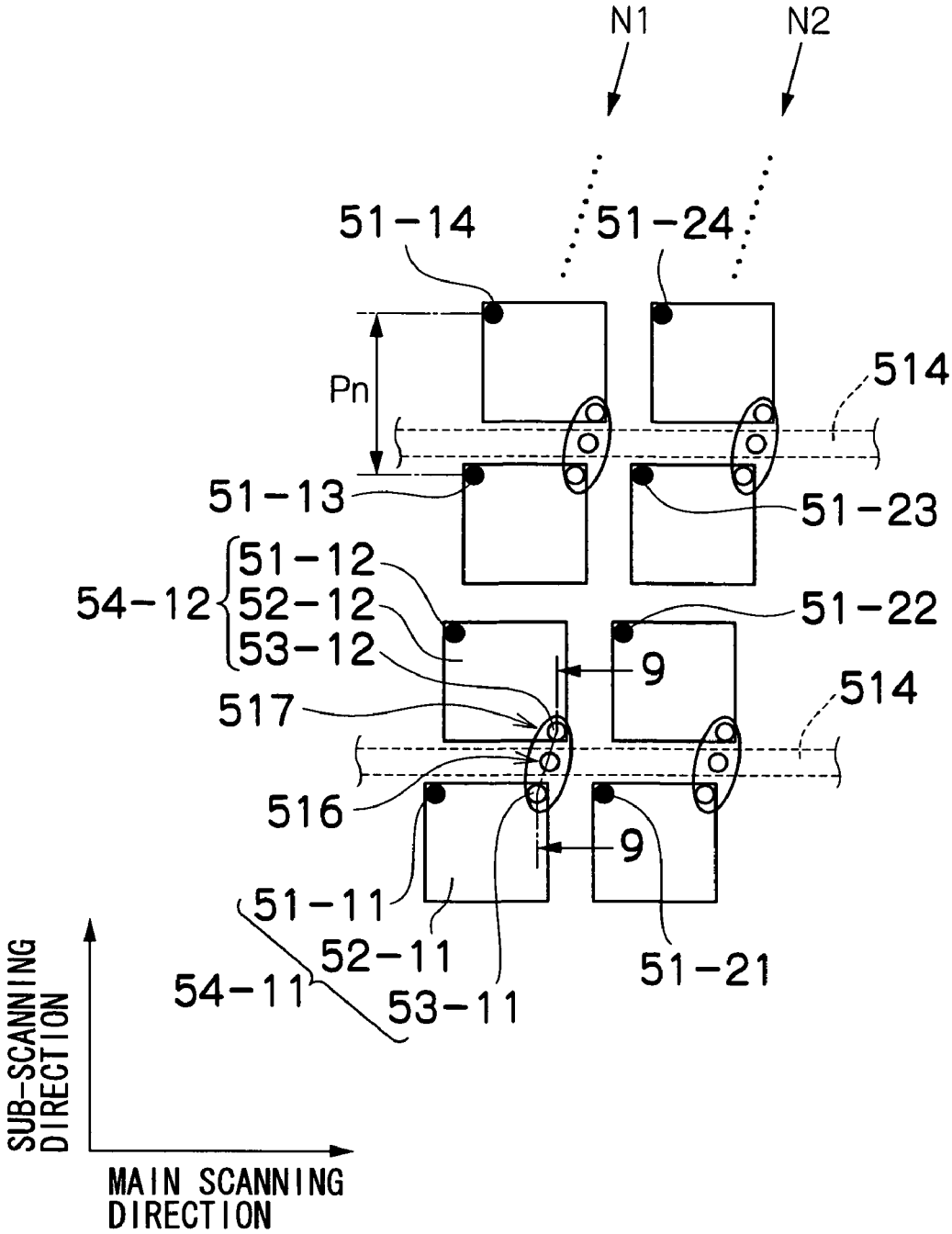
FIG. 8A is a plan perspective diagram showing the principal part of a print head according to a second embodiment of the present invention.

FIG. 8A shows a perspective plan diagram of the principal part of a print head according to the second embodiment. The overall composition of the inkjet recording apparatus according to the present embodiment is similar to that of the first embodiment described above. Furthermore, the arrangement of nozzles in the print head is also similar to that shown in FIG. 5, and the nozzle pitch Pn between nozzles which are adjacent in the sub-scanning direction is set so as to satisfy the formula (1) or (2).

Figure 8B:
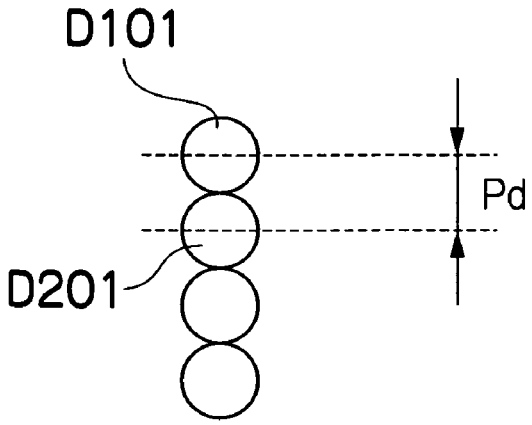
FIG. 8B is an enlarged view showing the relationship between nozzle pitch and dot pitch in the sub-scanning direction of the print head shown in FIG. 8A.
Figure 8B:
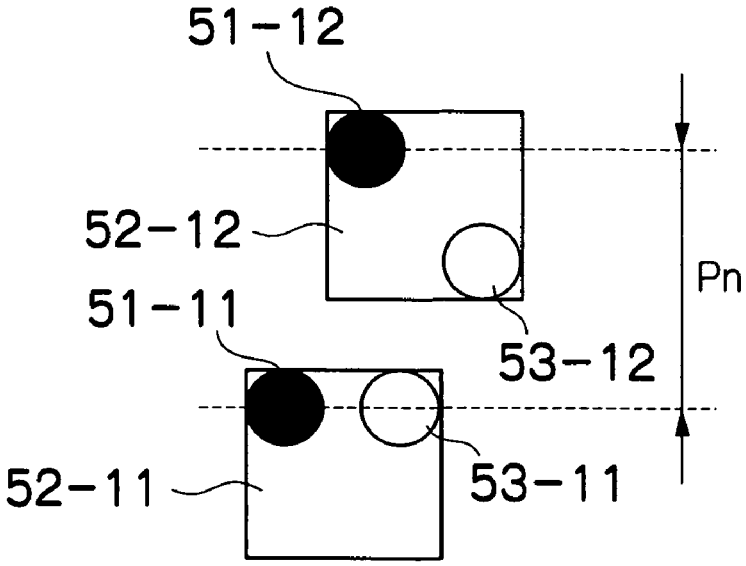

FIG. 8B shows an enlarged view of the relationship between the nozzle pitch Pn and the dot pitch Pd with respect to the nozzles that are mutually adjacent in the sub-scanning direction. Taking the dot pitch between dots that are adjacent in the sub-scanning direction, for example, dot D101 and dot D201, to be Pd, and taking the nozzle pitch between the nozzles that are adjacent in the sub-scanning direction, for example, nozzle 51-11 and nozzle 51-12, to be Pn, and taking m to be an integer not less than 1, and k to be any value in the range of $0.4 \leqq k \leqq 0.6$, then the nozzles 51 are arranged so as to satisfy the formula (2):

$$Pn=(m+k)\times Pd. \quad (2)$$

As described above, the formula (1) corresponds to a case where k=½ in the formula (2).

As shown in FIG. 8A, pressure chamber units 54 (54-11 and so on) each comprising a nozzle 51 (51-11 and so on), a pressure chamber 52 (52-11 and so on), and an ink supply port 53 (53-11 and so on), are arranged in a two-dimensional staggered matrix in a line direction which follows the main scanning direction and a row direction oblique to the main scanning direction.

In this case, the row of nozzles including the nozzles 51-11, 51-12, 51-13, 51-14, and so on, arranged in the row direction is called nozzle row N1 and similarly, the row of nozzles including the nozzles 51-21, 51-22, 51-23, 51-24, and so on, is called nozzle row N2.

The nozzle pitch Pn between the nozzles that are mutually adjacent in the sub-scanning direction, such as the nozzle rows N1 and N2, is set so as to satisfy formula (1). In the present embodiment, a supply restrictor that supplies ink is shared by the pressure chambers 52 of the pressure chamber units 54 that are adjacent in the sub-scanning direction. In other words, a common liquid chamber 514 is formed in parallel to the main scanning direction, between the pressure chambers 54 that are adjacent in the sub-scanning direction in the nozzle rows N1 and N2, in such a manner that ink is supplied from this common liquid chamber 514 to the pressure chambers 52 that are adjacent in the sub-scanning direction, by passing through the common supply restrictor.

This applies similarly to all of the pressure chamber units 54 that are adjacent in the sub-scanning direction, and here, the situation is described with respect to the pressure chamber units 54-11 and 54-12, which are mutually adjacent in the sub-scanning direction in the nozzle row N1.

In the pressure chamber units 54-11 and 54-12, the nozzles 51-11 and 51-12 are provided respectively in the upper left-hand corner of the respective pressure chambers 52-11 and 52-12, and their respective ink supply ports 53-11 and 53-12 are disposed in mutually proximate positions, facing each other on opposite sides of the common liquid chamber 514. In the example shown in FIG. 8A, the ink supply port 53-11 of the pressure chamber 52-11 is located in the upper right-hand corner, and the ink supply port 53-12 of the pressure chamber 52-12 is located in the lower right-hand corner.

A common supply flow channel 517 is provided for respectively supplying ink from the common liquid chamber 514 to the two ink supply ports 53-11 and 53-12, and a supply restrictor 516 is disposed in the center of this common supply flow channel 517. As shown in FIG. 8A, the supply flow channel 517 is connected to the two ink supply ports 53-11 and 53-12, and is composed in an oblique direction with respect to the common liquid chamber 514. The central portion of the supply flow channel 517 overlaps with the common liquid chamber 514, and the supply restrictor 516 is formed in this overlap section.

A more detailed description of this section is given below with reference to FIG. 9, which is a cross-sectional diagram along line 9-9 in FIG. 8A.

Figure 9:
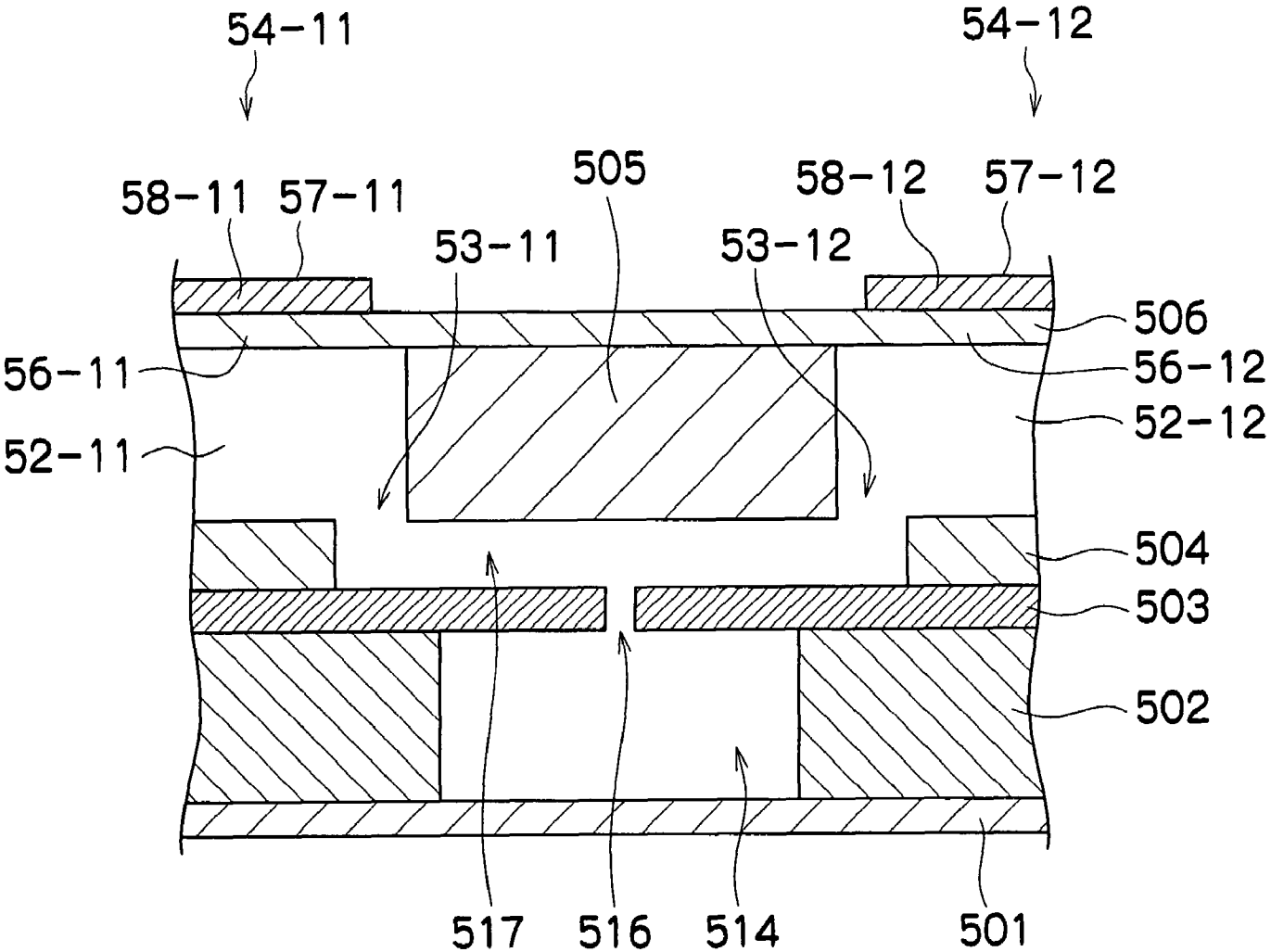
FIG. 9 is a cross-sectional diagram along line 9-9 in FIG. 8A.

As shown in FIG. 9, the respective pressure chamber units 54-11 and 54-12 are manufactured by layering together and bonding a plurality of plate members 501 to 506 each made of a thin plate member made of stainless steel, or the like. The pressure chambers 52-11 and 52-12, the common liquid chamber 514, the supply restrictor 516, the supply flow channel 517, and the like, are formed inside each pressure chamber unit.

In FIG. 9, the lowermost layer is a nozzle plate 501, and although not illustrated in the diagram, the nozzles 51-11, 51-12, and the like, are formed in this nozzle plate 501. A common liquid chamber plate 502 formed with the common liquid chamber 514, a supply restrictor plate 503 formed with the supply restrictor 516, a supply flow channel plate 504 formed with the supply flow channel 517, and a pressure chamber plate 505 formed with the pressure chambers 52-11, 52-12, and the like, are layered onto the nozzle plate 501.

The uppermost layer is a diaphragm plate 506, which forms the ceiling of the pressure chambers 52-11 and 52-12. The diaphragm plate 506 also serves as a common electrode. The diaphragm plate 506 forms the diaphragms 56-11 and 56-12, which deform in such a manner that the volumes of the regions of the pressure chambers 52-11 and 52-12 are changed.

Actuators (piezoelectric elements) 58-11 and 58-12 are disposed respectively on the diaphragms 56-11 and 56-12, and individual electrodes 57-11 and 57-12 are formed on the upper surface of the actuators 58-11 and 58-12. The actuators 58-11 and 58-12 are driven by applying a voltage between the common electrode (the diaphragms 56-11 and 56-12) and the individual electrodes 57-11 and 57-12, thereby causing the diaphragms 56-11 and 56-12 to deform and reducing the volume of the pressure chambers 52-11 and 52-12, in such a manner that ink is ejected from the nozzles (not illustrated).

As shown in FIG. 9, the two pressure chambers 52-11 and 52-12 are connected respectively to the supply flow channel 517 via the ink supply ports 53-11 and 53-12, and the supply flow channel 517 is connected to the common liquid chamber 514 via the supply restrictor 516. In other words, the two pressure chambers 52-11 and 52-12 share the single supply restrictor 516.

The supply restrictor 516 has a very fine shape and is provided so as to form a flow path resistance in order to prevent ink that has been supplied to the pressure chambers 52-11 and 52-12 from flowing back into the common liquid chamber 514 from the supply flow channel 517 via the supply restrictor 516. The supply restrictor 516 requires high-precision processing.

In this way, in the present embodiment, the common supply restrictor 516 is shared by the nozzles that are adjacent in the sub-scanning direction and eject droplets to form dots that are adjacent in the main scanning direction (for example, the nozzles 51-11 and 51-12, or the like; see FIGS. 5 and 8A), and therefore, the number of the supply restrictors 516 formed in the supply restrictor plate 503 and the number of the supply flow channels 517 formed in the supply flow channel plate 504 are a half of the number of the pressure chambers 52 (52-11, 52-12, and the like). Since the supply restrictors 516 and the supply flow channels 517 formed respectively in the supply restrictor plate 503 and the supply flow channel plate 504 are thus reduced in number and density in comparison with a case where they are formed in similar number to the pressure chambers 52 (52-11, 52-12, and the like), then the difficulty of processing the supply restrictors, which have very strict accuracy requirements, is reduced, and processing accuracy is improved.

Moreover, in the present embodiment, cross-talk is prevented by adopting a nozzle arrangement that satisfies the formula (1), and therefore, it becomes easier to share the common supply restrictors 516.

Next, a third embodiment of the present invention will be described. The third embodiment, similarly to the second embodiment described above, also uses shared supply restrictors for a plurality of pressure chambers, and the combination of pressure chambers sharing a supply restrictor is different from that of the second embodiment.

Figure 10:
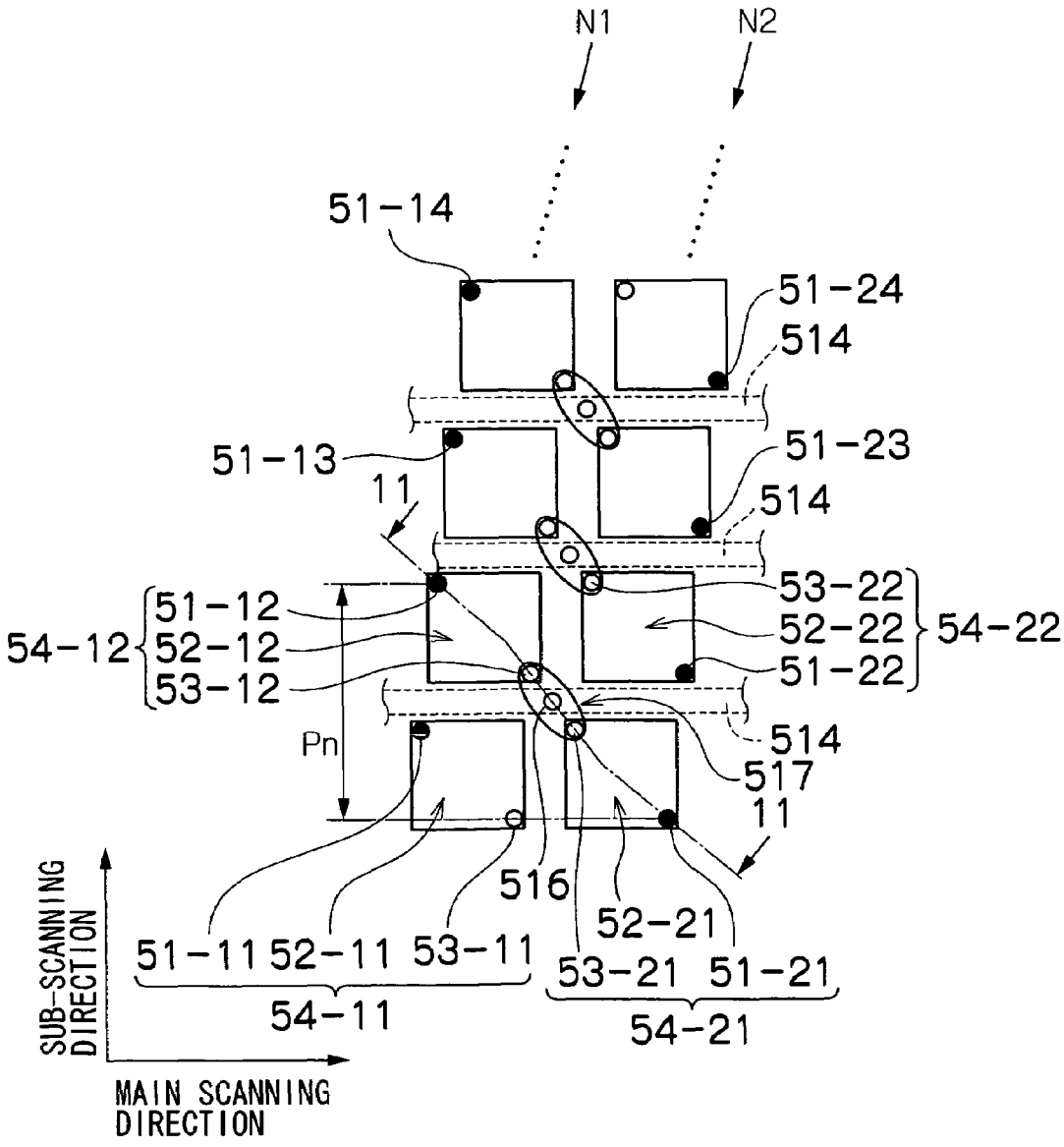
FIG. 10 is a plan perspective diagram showing the principal part of a print head according to a third embodiment of the present invention.

FIG. 10 shows perspective plan diagram of the principal part of a print head according to the present embodiment. The overall composition of the inkjet recording apparatus according to the present embodiment is similar to the first embodiment described above, and the arrangement of the pressure chamber units in the print head is similar to that shown in FIG. 5. The present embodiment differs from the foregoing embodiments in respect of the location of each nozzle within each pressure chamber, as described below.

As shown in FIG. 10, pressure chamber units 54 (54-11 and so on) each comprising a nozzle 51 (51-11 and so on), a pressure chamber 52 (52-11 and so on), and an ink supply port 53 (53-11 and so on), are arranged in a two-dimensional staggered matrix in a line direction parallel to the main scanning direction and a row direction oblique to the main scanning direction.

In this case, similarly to the second embodiment, the row of nozzles comprising the nozzles 51-11, 51-12, 51-13, 51-14, and so on, arranged in the row direction is called nozzle row N1 and similarly, the row of nozzles comprising the nozzles 51-21, 51-22, 51-23, 51-24, and so on, is called nozzle row N2.

As shown in FIG. 10, in the present embodiment, the nozzle 51 (51-11 and the like) and the ink supply port 53 (53-11 and the like) are disposed in each of the pressure chambers 52 (52-11 and the like) at diagonally opposite corners of the pressure chamber 52. Moreover, in nozzle rows which are mutually adjacent in the main scanning direction, such as the nozzle row N1 and the nozzle row N2, the ink supply ports 53-11, 53-12, . . . of the pressure chambers 52-11, 52-12, . . . in the nozzle row N1 are situated at the lower right-hand corners of the pressure chambers 52-11, 52-12, . . . ; and the ink supply ports 53-21, 53-22, . . . of the pressure chambers 52-21, 52-22, . . . in the nozzle row N2 are situated at the upper left-hand corners of the pressure chambers 52-21, 52-22, . . . . Thereby, the ink supply ports are disposed at mutually opposing positions in the diagonal direction.

For example, the ink supply port 53-12 of the pressure chamber 52-12 in the pressure chamber unit 54-12 of the nozzle row N1 and the ink supply port 53-21 of the pressure chamber 52-21 in the pressure chamber unit 54-21 of the nozzle row N2 are arranged at respectively opposing corners and are therefore mutually adjacent in a direction oblique to the sub-scanning direction.

A common supply flow channel 517 and a supply restrictor 516 are provided for the ink supply ports (e.g., the ink supply ports 53-12 and 53-21) that are adjacent in the direction oblique to the sub-scanning direction and span the two nozzle rows N1 and N2. Common liquid chambers 514 are provided respectively between the pressure chamber units which are adjacent in the sub-scanning direction. As shown in FIG. 10, the supply flow channels 517 are disposed obliquely with respect to the common liquid chambers 514, in such a manner that they are connected to the ink supply ports 53-12 and 53-21. Furthermore, the central portion of each supply flow channel 517 overlaps with the common liquid chamber 514, and the supply restrictor 516 is formed in this overlap section.

In this way, in the present embodiment, the supply restrictor 516 is shared by the nozzles 51-12 and 51-21, which are adjacent obliquely to the sub-scanning direction, spanning between the two nozzle rows N1 and N2. In the present embodiment, the nozzle pitch Pn defines the nozzle pitch in the sub-scanning direction between the nozzles 51-12 and 51-21, which share the supply restrictor 516.

Therefore, in the present embodiment, the nozzles are arranged in such a manner that the nozzle pitch Pn between the nozzles that share the supply restrictor 516 satisfies the formula (1).

Figure 11:
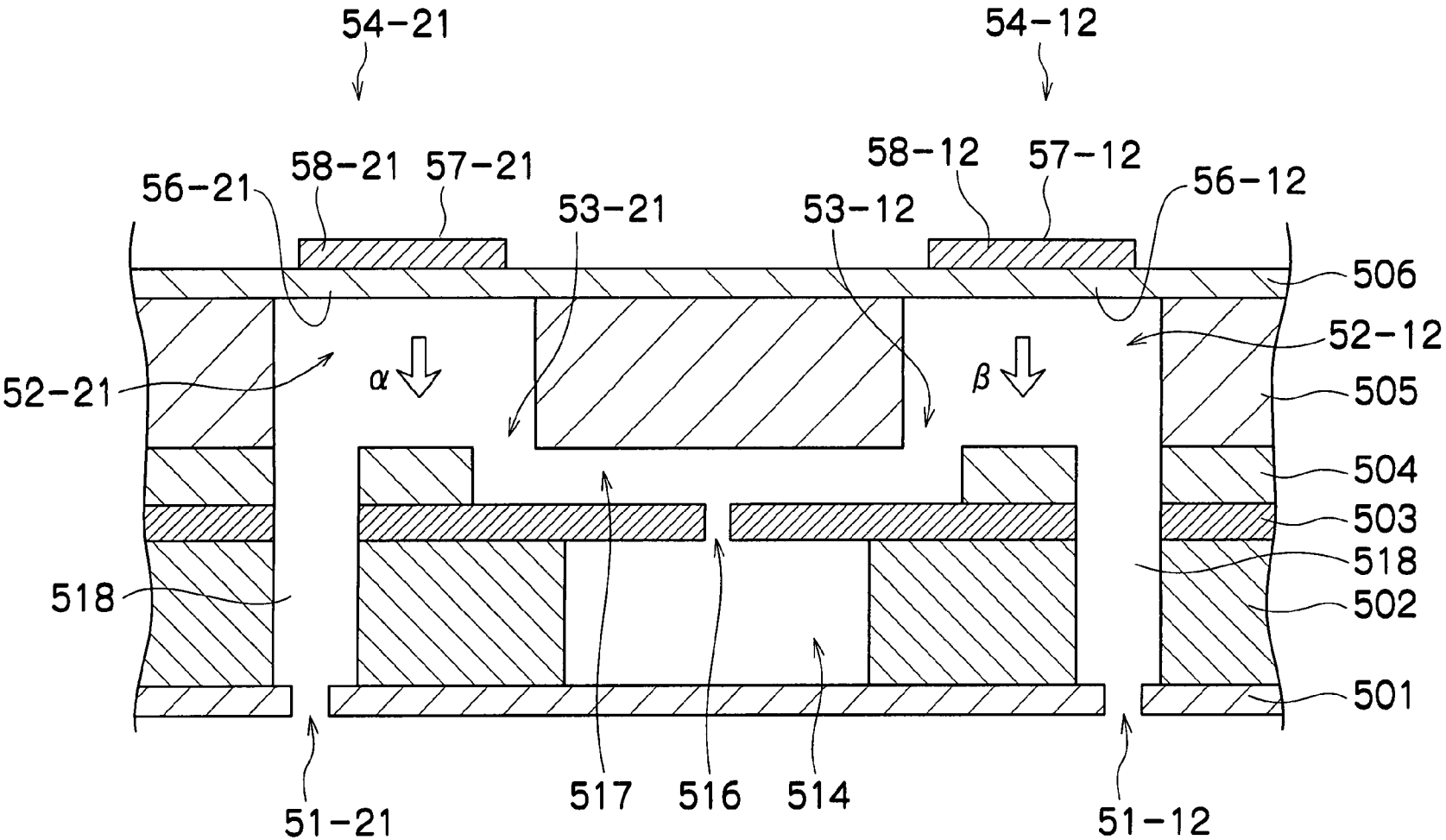
FIG. 11 is a cross-sectional diagram along line 11-11 in FIG. 10.

FIG. 11 is a cross-sectional diagram along line 11-11 in FIG. 10.

As shown in FIG. 11, the pressure chamber units 54-12 and 54-21 are manufactured by layering together and bonding a plurality of plate members 501 to 506 each made of a thin plate member made of stainless steel, or the like. The pressure chambers 52-12 and 52-21, the common liquid chamber 514, the supply restrictor 516, the supply flow channel 517, the nozzle flow channel 518, and the like, are formed inside the pressure chamber units.

A common liquid chamber plate 502 in which the nozzle flow channels 518 and the common liquid chambers 514 are formed is layered onto a nozzle plate 501 formed with the nozzles 51-12 and 51-21, and a supply restrictor plate 503 formed with the supply restrictors 516 and a supply flow channel plate 504 formed with the supply flow channels 517 are further layered onto same. A pressure chamber plate 505 formed with the pressure chambers 52-12 and 52-21 is layered onto this, and a diaphragm plate 506 forming the ceiling of the pressure chambers 52-12 and 52-21 is layered as an uppermost layer. The diaphragm plate 506 forms the diaphragms 56-12 and 56-21 in the regions of the pressure chambers 52-12 and 52-21, respectively, and actuators 58-12 and 58-21 are formed respectively on these diaphragms.

The diaphragm plate 506 also serves as a common electrode, and individual electrodes 57-12 and 57-21 are formed on the upper surface of the actuators 58-12 and 58-21. Here, when a voltage is applied between the common electrode (the diaphragm 56-21) and the individual electrode 57-21, for example, then the actuator 58-21 is driven, the diaphragm 56-21 deforms so as to reduce the volume of the pressure chamber 52-21, and pressure is applied to the ink as indicated by the arrow α in FIG. 11, thereby causing ink to be ejected from the nozzle 51-21.

In this way, in the present embodiment, the supply flow channel 517 and the supply restrictor 516 are shared by two pressure chambers 52-12 and 52-21, or the like, and the numbers of the supply flow channels 517 and the supply restrictors 516 formed in the plate members are a half of the number of the pressure chambers 52 (52-12, 52-21, and the like). Therefore, similarly to the second embodiment described above, it is possible to reduce the difficulty of processing the supply restrictors, which have particularly strict accuracy requirements, and processing accuracy can also be improved.

Moreover, since the pressure chambers that are adjacent in the sub-scanning direction, such as the pressure chambers 52-11 and 52-12, do not share the supply restrictor, then the effects of cross-talk are relatively small compared to the pressure chambers 52-12 and 52-21 that are adjacent in the direction oblique to the sub-scanning direction, and hence there is little requirement to arrange the nozzles in such a manner that the nozzle pitch between the nozzles 51-11 and 51-12 of the pressure chambers satisfies the formula (1).

Furthermore, compared to the nozzle arrangement in the second embodiment illustrated in FIG. 8A, in the nozzle arrangement of the third embodiment illustrated in FIG. 10, the nozzle and the ink supply port are disposed at diagonally opposite positions inside each pressure chamber. Therefore, air bubbles become less liable to stagnate within the pressure chambers and refilling properties are improved.

Next, a fourth embodiment of the present invention will be described.

When a supply restrictor is shared by two pressure chambers, as in the second embodiment shown in FIG. 8A or the third embodiment shown in FIG. 10, the two pressure chambers that share the supply restrictor are located effectively within the same chamber; however, as described above, since the nozzles that are adjacent in the sub-scanning direction are arranged so as to satisfy the formula (1), the ejection cycles of the nozzles are staggered by ½ a cycle, thus staggering the drive timings and avoiding simultaneous ejection. Therefore, cross-talk can be prevented.

The fourth embodiment enhances the cross-talk prevention effect yet further, by generating drive waveforms for the pressure chambers as described below, when one supply restrictor is shared by a plurality of pressure chambers.

Figure 12:
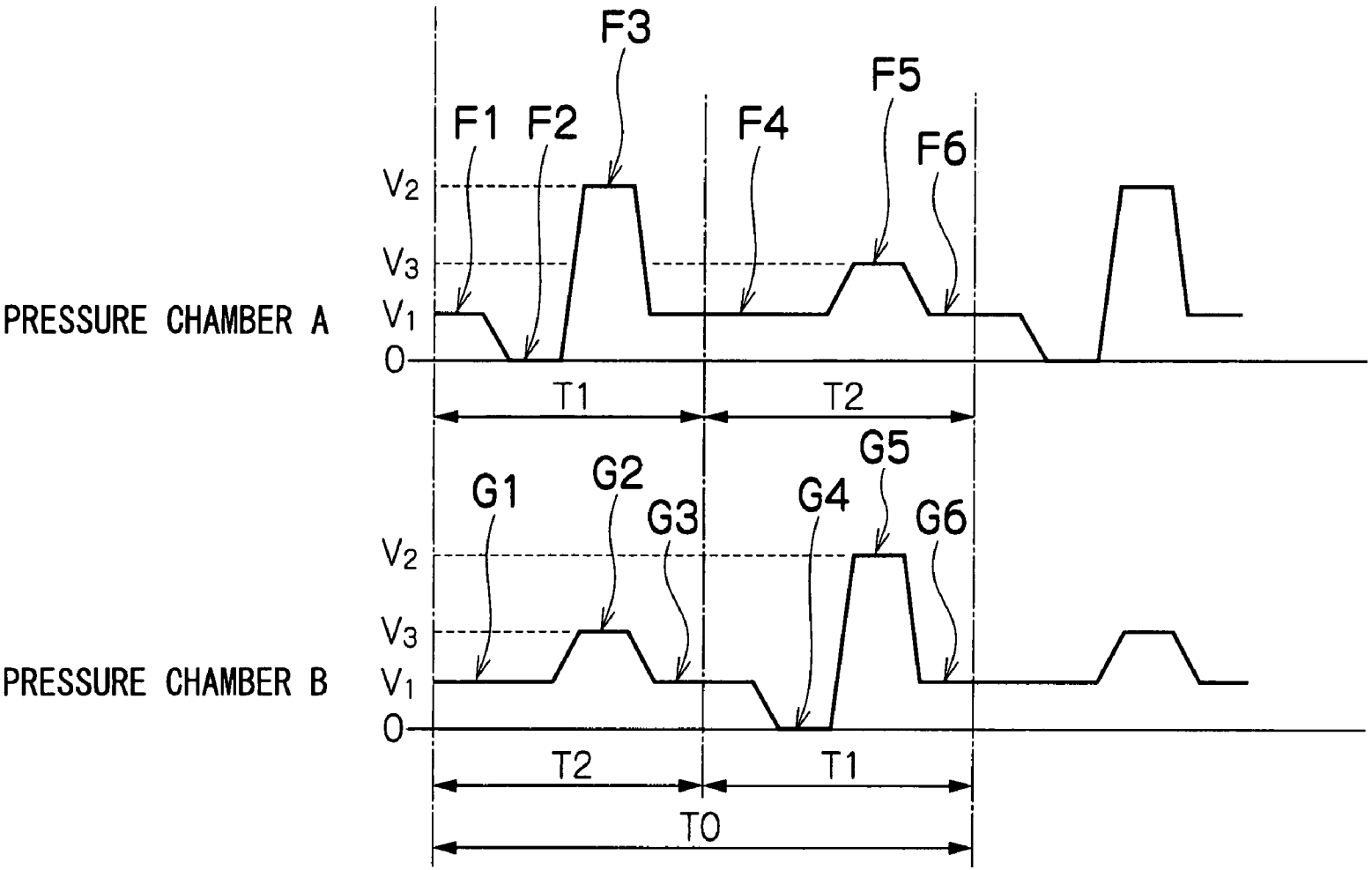
FIG. 12 is a graph diagram showing the drive waveforms for pressure chambers relating to a fourth embodiment of the present invention.

FIG. 12 shows the drive waveforms for two pressure chambers which share one supply restrictor, according to the present embodiment. More specifically, FIG. 12 shows the drive waveforms for two pressure chambers A and B that share one supply restrictor, and in FIG. 12, the horizontal axis indicates time and the vertical axis indicates voltage. Here, the pressure chamber A and the pressure chamber B share one supply restrictor, and these pressure chambers correspond to the pressure chamber 52-11 and the pressure chamber 52-12 in FIG. 8A, or the pressure chamber 52-12 and the pressure chamber 52-21 in FIG. 10, or the like.

In the following description, it is supposed that the pressure chamber A is the pressure chamber 52-21 in FIG. 10 and the pressure chamber B is the pressure chamber 52-12 in FIG. 10. As described in the third embodiment, the nozzles 51-21 and 51-12 of the pressure chambers 52-21 and 52-12 are arranged so as to satisfy the formula (1), and the phases of the ejection cycles of the nozzles 51-21 and 51-12 are staggered by ½, in such a manner that ejection is performed from the nozzles 51-21 and 51-12 in an alternating fashion. Consequently, if one of the nozzles 51-21 and 51-12 is performing ejection, the other nozzle does not perform ejection.

In FIG. 12, the pressure chamber A is the pressure chamber 52-21 in FIG. 10, and the pressure chamber B is the pressure chamber 52-12 in FIG. 10. The drive waveforms for the actuators 58-21 and 58-12, which correspond to the pressure chambers 52-21 and 52-12, are controlled by the head driver 84 (see FIG. 7). In the graph of the drive voltage waveform for the pressure chamber A (the pressure chamber 52-21) in FIG. 12, the region F1 relates to a state of steady voltage V1 where no ejection is performed. In this case, the diaphragm 56-21 (see FIG. 11) is in a state where it is bent slightly toward the inside of the pressure chamber 52-21.

When performing ejection, firstly, the voltage is changed to 0, as shown in F2, the bend in the diaphragm 56-21 is removed, and the volume of the pressure chamber 52-21 is increased accordingly. Therefore, ink flows into the pressure chamber 52-21 from the ink supply port 53-21 (see FIG. 11), and the meniscus surface at the nozzle 51-21 is withdrawn into the nozzle flow channel 518.

Next, as shown in F3, the actuator 58-21 is driven by applying a voltage V2, the diaphragm 56-21 is deformed toward the inside of the pressure chamber 52-21, and hence pressure is applied to the ink as indicated by the arrow a in FIG. 11. The ink pushed by this pressure is ejected from the nozzle 51-21 by passing through the nozzle flow channel 518. The waveform indicated by F3 is the ejection drive waveform that actually ejects the ink. After ejection of the ink, as shown in F4, the voltage returns again to a steady voltage of V1. Since the portion T1 of the waveform up to this point relates to a state of performing an ejection operation, it is called the "ejection region".

In this way, during ejection, a pressure wave as indicated by the arrow α in FIG. 11 is generated inside the pressure chamber 52-21, by the driving of the actuator 58-21. By means of this pressure wave generated in the pressure chamber 52-21, an ink flow is created passing through the supply flow channel 517 in the direction of the pressure chamber 52-12, and this flow may influence the ejection of ink. Therefore, in order to reduce this influence, the pressure chamber 52-12 to which a steady voltage of V1 has been applied as indicated by G1 when no ejection is performed, is applied with an auxiliary drive waveform of voltage V3, as indicated by G2, in synchronism with the application of the ejection voltage V2 to the pressure chamber 52-21 in F3, the voltage V3 being represented by a waveform of a similar direction to the ejection drive waveform F3 but being of a level which does not produce ejection.

Due to this voltage V3 applied by the auxiliary drive waveform G2, which acts in a similar direction to the ejection drive waveform F3 in synchronism with same, but which produces no ejection, a pressure wave as indicated by the arrow β in FIG. 11 is created in the pressure chamber 52-12 by the actuator 58-12, and this pressure wave acts to push back the ink flow toward the supply flow channel 517 caused by the pressure wave from the pressure chamber 52-21, which shares the same supply flow channel 517. Therefore, the pressure (reduction in volume) caused by the displacement of the actuator 58-21 is transmitted efficiently to the nozzle flow channel 518 of the pressure chamber 52-21 and hence a large ejection force can be obtained. Furthermore, by this means, a greater cross-talk prevention effect can be obtained. After applying the auxiliary drive waveform, the voltage returns to the steady voltage V1 state as indicated by G3. The portion T2 of the waveform for the pressure chamber B (the pressure chamber 52-12) up to this point is called the "standby region", since it relates to a state where no ejection is performed.

As described above, the nozzle 51-21 and the nozzle 51-12 perform ejection alternately, ½ a cycle apart. Then, the nozzle 51-12 subsequently performs ejection. A voltage of a similar waveform to that of the ejection region T1 of the pressure chamber A in FIG. 12 is applied to the pressure chamber 52-12 (the pressure chamber B).

More specifically, firstly, the voltage applied to the pressure chamber 52-12 is reduced to 0 as indicated in G4, whereupon an ejection drive waveform is applied as shown in G5, and ink is ejected from the nozzle 51-12. In this case, an auxiliary drive waveform as indicated by F5 is applied to the other pressure chamber 52-21 in synchronism with the ejection drive waveform in G5. Thereupon, the voltages are returned respectively to the steady voltage states indicated by G6 and F6.

In this way, the two pressure chambers 52-21 and 52-12, which share the one supply restrictor 516, perform ejection alternately, and when the waveform for one pressure chamber is in the ejection region T1, the waveform for the other is in the standby region T2. These states are switched alternately, at ½ a cycle apart. More specifically, the time period of the ejection region T1 and the standby region T2 combined is one ejection cycle T0.

In the present embodiment, the nozzles of two pressure chambers that share one supply restrictor are arranged in such a manner that their ejection cycles are staggered by ½ a cycle, and when ejection is performed by driving these two pressure chambers alternately, then at the moment of ejection by means of an ejection drive waveform from one pressure chamber, an auxiliary drive waveform of the same direction as the ejection drive waveform and synchronized with same is applied to the other pressure chamber, so as to create a pressure which does not produce ejection in the other pressure chamber, in such a manner that the ink in the first pressure chamber does not flow into the other pressure chamber. Therefore, it is possible further to enhance the cross-talk prevention effect.

As described above, according to the various embodiments, it is possible to avoid simultaneous ejection operations from adjacently positioned nozzles, and hence to prevent cross-talk, by arranging nozzles that eject droplets to form dots that are mutually adjacent in the main scanning direction on the recording paper in such a manner that the nozzle pitch in the sub-scanning direction is staggered by ½ of the ejection cycle.

Furthermore, by sharing a supply restrictor between pressure chambers that are adjacent in the sub-scanning direction or in a direction oblique to the sub-scanning direction, it is possible to reduce the number of supply restrictors, which require particularly high processing accuracy, and hence processing accuracy can be improved.

Moreover, by contriving the drive waveforms for the pressure chambers that share a supply restrictor in such a manner that an auxiliary drive waveform which lies in the same direction as the ejection drive waveform for one pressure chamber and which is synchronized with same, but which does not reach a level that produces ejection, is applied to the other pressure chamber, then it is possible further to increase the cross-talk prevention effect.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A full line type liquid droplet ejection head, comprising:

a plurality of pressure chambers; and a plurality of nozzles which correspond to the pressure chambers and are two-dimensionally arranged through a length corresponding to a full width of a recording medium conveyed in a sub-scanning direction relatively to the liquid droplet ejection head, wherein a nozzle pitch Pn in the sub-scanning direction between two of the nozzles corresponding to two of the pressure chambers sharing a supply restrictor through which liquid is supplied to the two of the pressure chambers satisfies the following formula:

$$Pn=(m+k)\times Pd,$$

where Pd is a minimum pitch between dots in the sub-scanning direction corresponding to a recording resolution in the sub-scanning direction of the dots on the recording medium, m is an integer not less than 1, and k is an arbitrary constant set in a range of $0.4 \leqq k \leqq 0.6$, the two of the nozzles are mutually adjacent in a direction oblique to the sub-scanning direction, the two of the pressure chambers corresponding to the two of the nozzles are connected to a supply flow channel through supply ports through which the liquid is supplied to the two of the pressure chambers, the supply flow channel is connected to a common liquid chamber through the supply restrictor, each of the pressure chambers has approximately a square plane shape, in each of the pressure chambers, the nozzle and the supply port are arranged on a diagonal of the pressure chamber, and the supply ports of the two of the pressure chambers which are adjacent in the direction oblique to the sub-scanning direction are arranged in mutually proximate and opposing positions.

2. The liquid droplet ejection head as defined in claim 1, wherein the constant k is 0.5.

3. A liquid droplet ejection device, comprising:

the liquid droplet ejection head as defined in claim 1; and an actuator control device which controls drive waveforms for actuators to generate pressure in the pressure chambers, wherein:

each of the drive waveforms includes: an ejection region which has an ejection drive waveform for applying pressure to the pressure chamber so as to actually eject a droplet of the liquid from the nozzle; and a standby region which does not have the ejection drive waveform and does not cause ejection;

when the drive waveform corresponding to one of the two of the pressure chambers which share the supply restrictor is in the ejection region, then the drive waveform corresponding to the other of the two of the pressure chambers is in the standby region; and the standby region has an auxiliary drive waveform which is a waveform acting in same direction as, and being synchronized with, the ejection drive waveform in the ejection region of the drive waveform corresponding to the one of the two of the pressure chambers, the auxiliary drive waveform being of a magnitude which does not cause ejection of a droplet of the liquid.

4. A liquid droplet ejection device, comprising:

the liquid droplet ejection head as defined in claim 2; and an actuator control device which controls drive waveforms for actuators to generate pressure in the pressure chambers, wherein:

each of the drive waveforms includes: an ejection region which has an ejection drive waveform for applying pressure to the pressure chamber so as to actually eject a droplet of the liquid from the nozzle; and a standby region which does not have the ejection drive waveform and does not cause ejection;

when the drive waveform corresponding to one of the two of the pressure chambers which share the supply restrictor is in the ejection region, then the drive waveform corresponding to the other of the two of the pressure chambers is in the standby region; and the standby region has an auxiliary drive waveform which is a waveform acting in same direction as, and being synchronized with, the ejection drive waveform in the ejection region of the drive waveform corresponding to the one of the two of the pressure chambers, the auxiliary drive waveform being of a magnitude which does not cause ejection of a droplet of the liquid.

5. An image forming apparatus, comprising the liquid droplet ejection head as defined in claim 1.

6. An image forming apparatus, comprising the liquid droplet ejection device as defined in claim 3.

7. An image forming apparatus, comprising the liquid droplet ejection device as defined in claim 4.

8. A full line type liquid droplet ejection head comprising:

a plurality of pressure chambers; and a plurality of nozzles which correspond to the pressure chambers and are two-dimensionally arranged through a length corresponding to a full width of a recording medium conveyed in a sub-scanning direction relatively to the liquid droplet ejection head, wherein a nozzle pitch Pn in the sub-scanning direction between two of the nozzles corresponding to two of the pressure chambers sharing a supply restrictor through which liquid is supplied to the two of the pressure chambers satisfies the following formula, $$Pn=(m+k)\times Pd,$$

where Pd is a minimum pitch between dots in the sub-scanning direction corresponding to a recording resolution in the sub-scanning direction of the dots on the recording medium, m is an integer not less than 1, and k is an arbitrary constant set in a range of $0.4 \leqq k \leqq 0.6$, the two of the nozzles are mutually adjacent in the sub-scanning directions, the two of the pressure chambers corresponding to the two of the nozzles are connected to a supply flow channel through supply ports through which the liquid is supplied to the two of the pressure chambers, the supply flow channel is connected to a common liquid chamber through the supply restrictor, each of the pressure chambers has approximately a square plane shape, in each of the pressure chambers, the nozzle and the supply port are arranged on a diagonal of the pressure chamber, and the supply ports of the two of the pressure chambers which are mutually adjacent in the sub-scanning direction are arranged in mutually proximate and opposing positions.

* * * * *